US011528955B1

(12) United States Patent
Rodriguez

(10) Patent No.: US 11,528,955 B1
(45) Date of Patent: Dec. 20, 2022

(54) PERSONAL PROTECTIVE HEADGEAR

(71) Applicant: Jose Angel Rodriguez, Orlando, FL (US)

(72) Inventor: Jose Angel Rodriguez, Orlando, FL (US)

( * ) Notice: Subject to any disclaimer, the term of this patent is extended or adjusted under 35 U.S.C. 154(b) by 0 days.

(21) Appl. No.: 17/512,519

(22) Filed: Oct. 27, 2021

Related U.S. Application Data

(60) Provisional application No. 63/144,391, filed on Feb. 1, 2021.

(51) Int. Cl.
*A42B 3/28* (2006.01)
*A42B 3/04* (2006.01)
*A62B 18/04* (2006.01)

(52) U.S. Cl.
CPC ..... *A42B 3/286* (2013.01); *A42B 3/044* (2013.01); *A42B 3/0453* (2013.01); *A62B 18/045* (2013.01)

(58) Field of Classification Search
CPC ..... A42B 3/044; A42B 3/0453; A42B 3/286; A62B 18/045
See application file for complete search history.

(56) References Cited

U.S. PATENT DOCUMENTS

| | | | | |
|---|---|---|---|---|
| 5,533,500 | A | 7/1996 | Her-Mou | |
| 5,577,495 | A | 11/1996 | Murphy | |
| 6,622,311 | B2 | 9/2003 | Diaz | |
| 8,549,672 | B2 | 10/2013 | Stevens | |
| 8,756,715 | B1 | 6/2014 | Moffitt | |
| 2015/0090254 | A1 * | 4/2015 | Pavalarajan | A42B 3/286 128/201.23 |

* cited by examiner

*Primary Examiner* — Thomas M Sember

(57) ABSTRACT

A personal protective headgear is an apparatus fully enclosing a user's head, protecting not only from potential contamination of breathing air but also from potential physical damage. A facial shield is hermetically sealed around the front-facing portion of the apparatus, preventing entrance of unfiltered air. Fans direct air through a set of filters, thus cleansing air entering the apparatus. The apparatus may further be equipped with a variety of interactivity modules, including cameras, speakers, lights, displays, and more. A set of sensors may be utilized to monitor the user and the user's surroundings in different conditions. The apparatus may also include wireless capabilities that allow the wearer to transfer information to and from a remote user, thereby allowing the user to follow instructions or otherwise interact with a guide or other such remote companion. Swappable battery packs allow the user to avoid losing power, even while replenishing power supplies.

15 Claims, 7 Drawing Sheets

PERSONAL PROTECTIVE HEADGEAR

The current application claims a priority to the U.S. Provisional Pat. application serial number 63/144,391 filed on Feb. 1, 2021.

FIELD OF THE INVENTION

The present invention generally relates to the field of personal protective equipment directed towards defense against physical and respiratory hazards. More specifically, the present invention is a self-contained powered air filtration apparatus equipped with multiple accessory functions.

BACKGROUND OF THE INVENTION

In present times, the constant threat of the novel coronavirus has spiked demands for personal protective equipment that is both effective and comfortable for use over extended time periods. Though now-ubiquitous paper masks are more effective than nothing at all, these items were only ever intended to be stop-gap measures before a more effective solution could be realized. At present, the natural next step would be the use of powered air purifier apparatuses, wherein air is filtered before entering a totally enclosed environment bubble enclosing a wearer's face.

However, existing systems often fail to meet consumer needs and expectations. Many solutions are very bulky, requiring a remote filter unit connected to an inflated headpiece by a hose. This type of soft-suit is also generally unsuitable for daily extended use in even mildly hostile environments, wherein the risk of a tear or puncture would render the unit largely useless. Other such units fail to adequately create and maintain a clean breathing space adjacent to the user's face, often leaving parts of the user's face exposed. Thus, improvement is warranted in this field, ideally providing a low-profile, self-contained protective helm suitable for extended use. Keeping the potential hostility of certain environments in mind, it is also considered that a means of passively disabling potential belligerents would be a valuable addition to such an implement. Likewise, the ability to document, review, and consult with a medical professional remotely may be desirable, given the rise of 'telemedicine' as a common practice.

The present invention addresses these issues. The personal protective headgear fully encloses a user's head, protecting not only from potential contamination of breathing air but also from potential physical damage. A facial shield is hermetically sealed around the front-facing portion of the present invention, preventing entrance of unfiltered air. A set of fans directs air through a set of filters, thus cleansing air entering the present invention. The present invention may further be equipped with a variety of interactivity modules, including cameras, speakers, lights, displays, and more. A set of sensors may be utilized to monitor the user and the user's surroundings in different conditions. The present invention may also include wireless capabilities that allow the wearer to transfer information to and from a remote user, thereby allowing the user to follow instructions or otherwise interact with a guide or other such remote companion. Swappable battery packs allow the user to avoid losing power, even while replenishing power supplies.

DETAILED DESCRIPTION OF THE INVENTION

All illustrations of the drawings are for the purpose of describing selected versions of the present invention and are not intended to limit the scope of the present invention.

Figure 1:
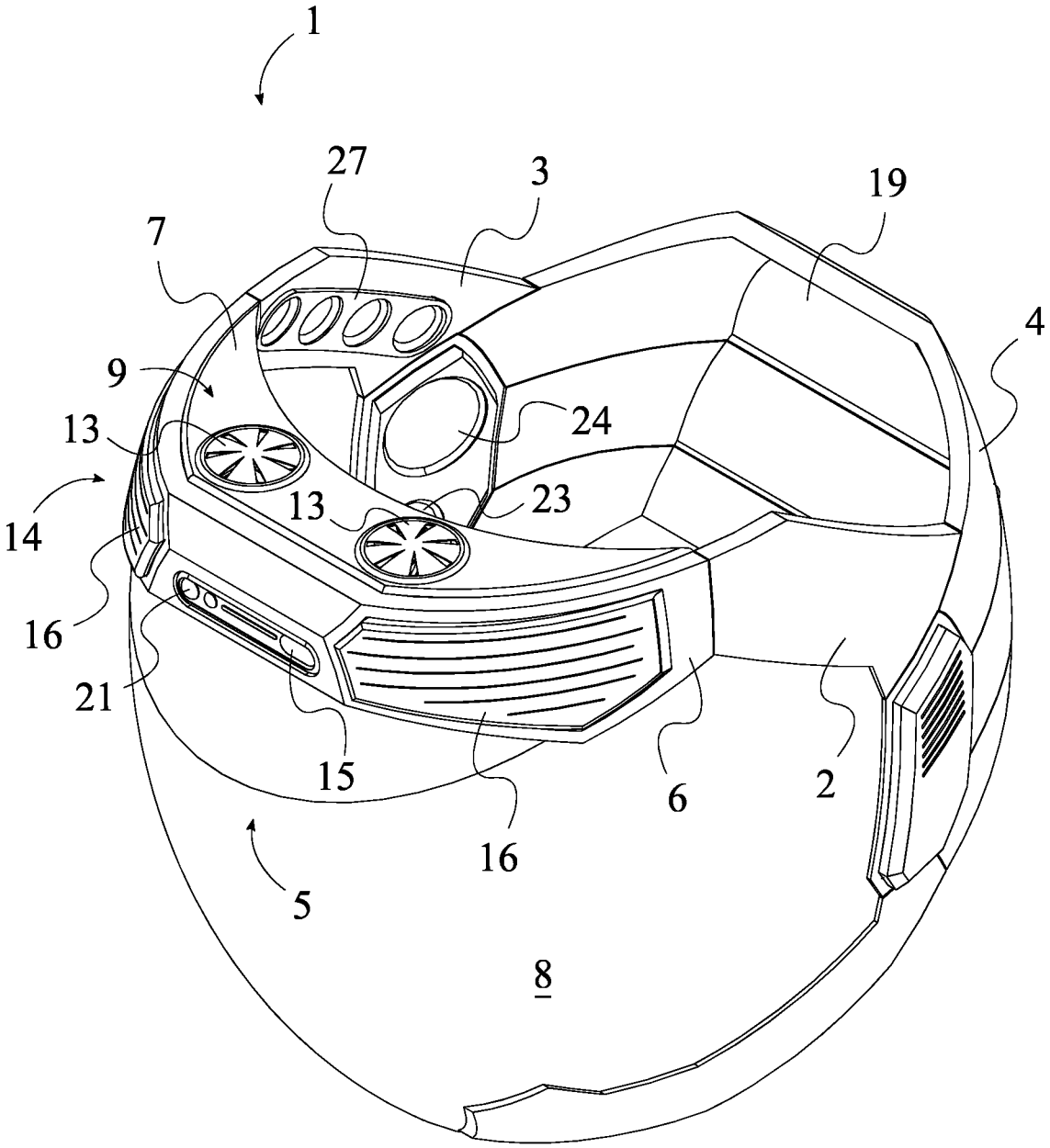
FIG. 1 is a front perspective view of the present invention.

The present invention is a personal protective headgear that is used to provide filtered air to a user. The present invention is also configured to protect the user's head from potential physical damage. The present invention comprises a frame 1, a transparent shield visor 8, at least one ventilation system 9, an illumination system 14, a modular power supply 17, and a controller 18, as shown in FIG. 1. The frame 1 is a structural unit about which the transparent shield visor 8, the at least one ventilation system 9, the illumination system 14, the modular power supply 17, and the controller 18 may be mounted. The transparent shield visor 8 is a clear panel which, in the preferred usage of the present invention, protects the user's face from exposure to external contaminants. The illumination system 14 denotes a set of lights which may illuminate locations around the user as desirable by the user. The modular power supply 17 is a portable power storage source that can be hot-swapped during use, enabling the user to continue utilizing the at least one ventilation system 9, illumination system 14, and controller 18 as needed. The controller 18 is an electronic unit which receives electronic signal inputs, stores and/or manipulates the signal, and relays signal responses to appropriate electronic devices distributed about the frame 1.

Figure 2:
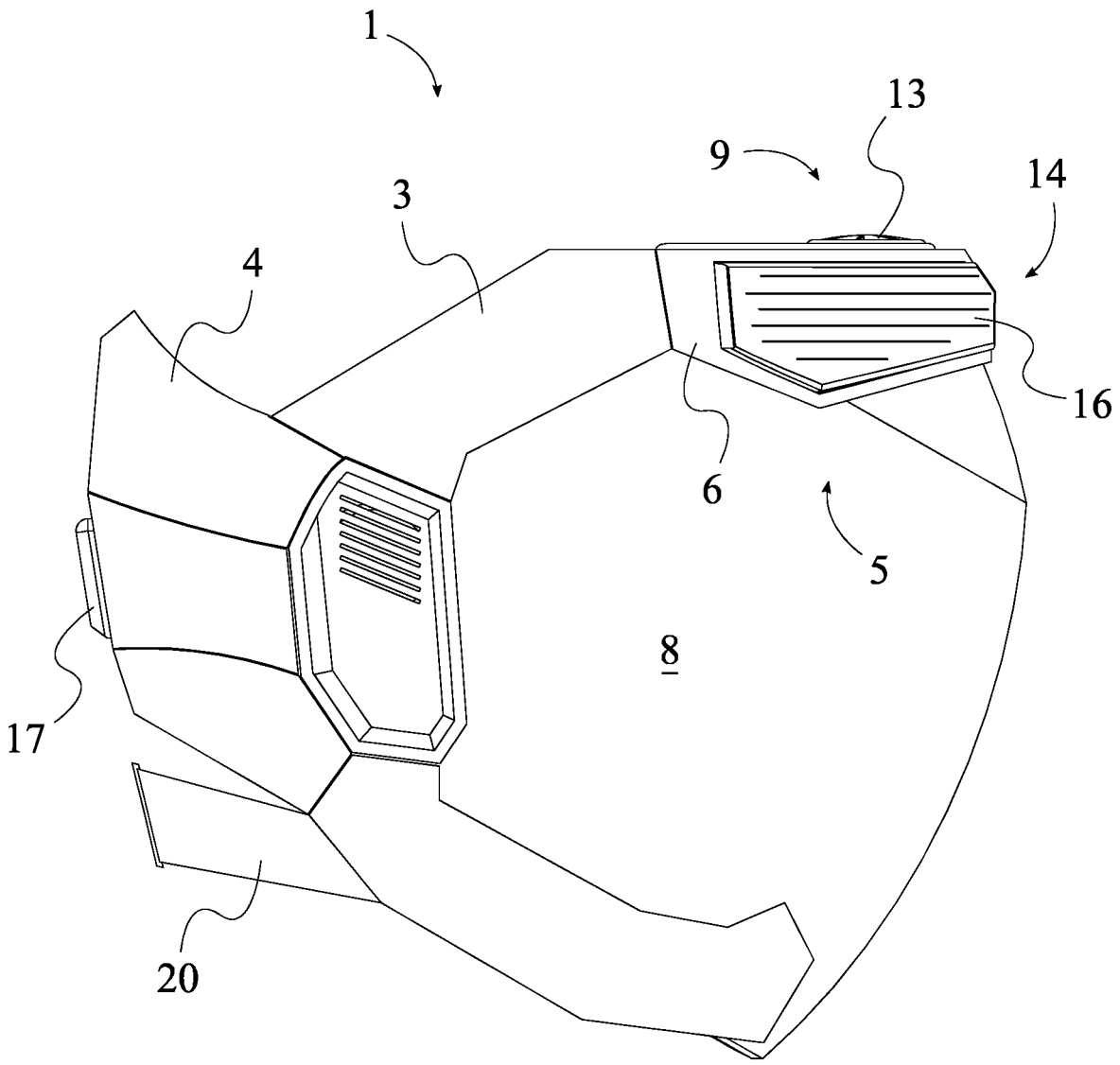
FIG. 2 is a left view of the present invention.

The general configuration of the aforementioned components allows the present invention to efficiently and effectively provide a user with clean, filtered air. The frame 1 comprises a left lateral cowl 2, a right lateral cowl 3, a rear brace 4, and a forehead brace 5, as shown in FIG. 2. The left lateral cowl 2 is the rigid segment of the frame 1 which, in the preferred usage of the present invention, protects the left side of the user's face, generally along the user's left jawline. Similarly, the right lateral cowl 3 is the rigid segment of the frame 1 which, in the preferred usage of the present invention, protects the right side of the user's face, generally along the user's right jawline. The rear brace 4 is the rigid segment of the frame 1 that protects the back of the user's head. The forehead brace 5 is the rigid segment of the frame 1 that protects the user's forehead and frontal scalp area. The forehead brace 5 comprises a proximal portion 6 and a distal portion 7. The proximal portion 6 is the segment of the forehead brace 5 that generally extends over the user's forehead area. The distal portion 7 is the segment of the forehead brace 5 that generally extends atop the front of a user's head. The left lateral cowl 2 and the right lateral cowl 3 may be bisymmetrically positioned offset to each other. This arrangement enables the left lateral cowl 2 and the right lateral cowl 3 to protect equal portions of the opposing portions of the user's head. The forehead brace 5 and the rear brace 4 may be mounted in between the left lateral cowl 2 and the right lateral cowl 3. In this way, the forehead brace 5 and the rear brace 4 may be positioned adjacent to their intended segments of protection. The forehead brace 5 and the rear brace 4 may be positioned opposite to each other about the frame 1. Thus, the forehead brace 5 and the rear brace 4 may protect the front and back of a user's head, respectively. The transparent shield visor 8 may be hermetically connected in between the left lateral cowl 2, the right lateral cowl 3, and the proximal portion 6. This arrangement ensures that air and contaminants cannot enter around the edges of the transparent shield visor 8 to the user's face.

The present invention must further be equipped to provide visual area illumination and air filtration to the user. To this end, the illumination system 14 may be integrated into the proximal portion 6. In this way, the illumination system 14 is positioned to illuminate areas within the user's field of view. The at least one ventilation system 9 may be integrated into the distal portion 7. Thus, air may flow through the front of the frame 1 down across the transparent shield visor 8, thereby simultaneously pulling external air through the at least one ventilation system 9 across the transparent shield visor 8 and pushing user exhalations down away from purified air. The modular power supply 17 and the controller 18 may be mounted into the frame 1. In this way, the modular power supply 17 and the controller 18 may be positioned optimally for convenient electronic connection to relevant components throughout the present invention. The controller 18 may be electronically connected to the at least one ventilation system 9 and the illumination system 14. This arrangement enables the controller 18 to provide directive signals to the at least one ventilation system 9 and the illumination system 14. The modular power supply 17 may be electrically connected to the at least one ventilation system 9, the illumination system 14, and the controller 18. Thus, the modular power supply 17 may provide electronic power to the at least one ventilation system 9, the illumination system 14, and the controller 18.

Figure 5:
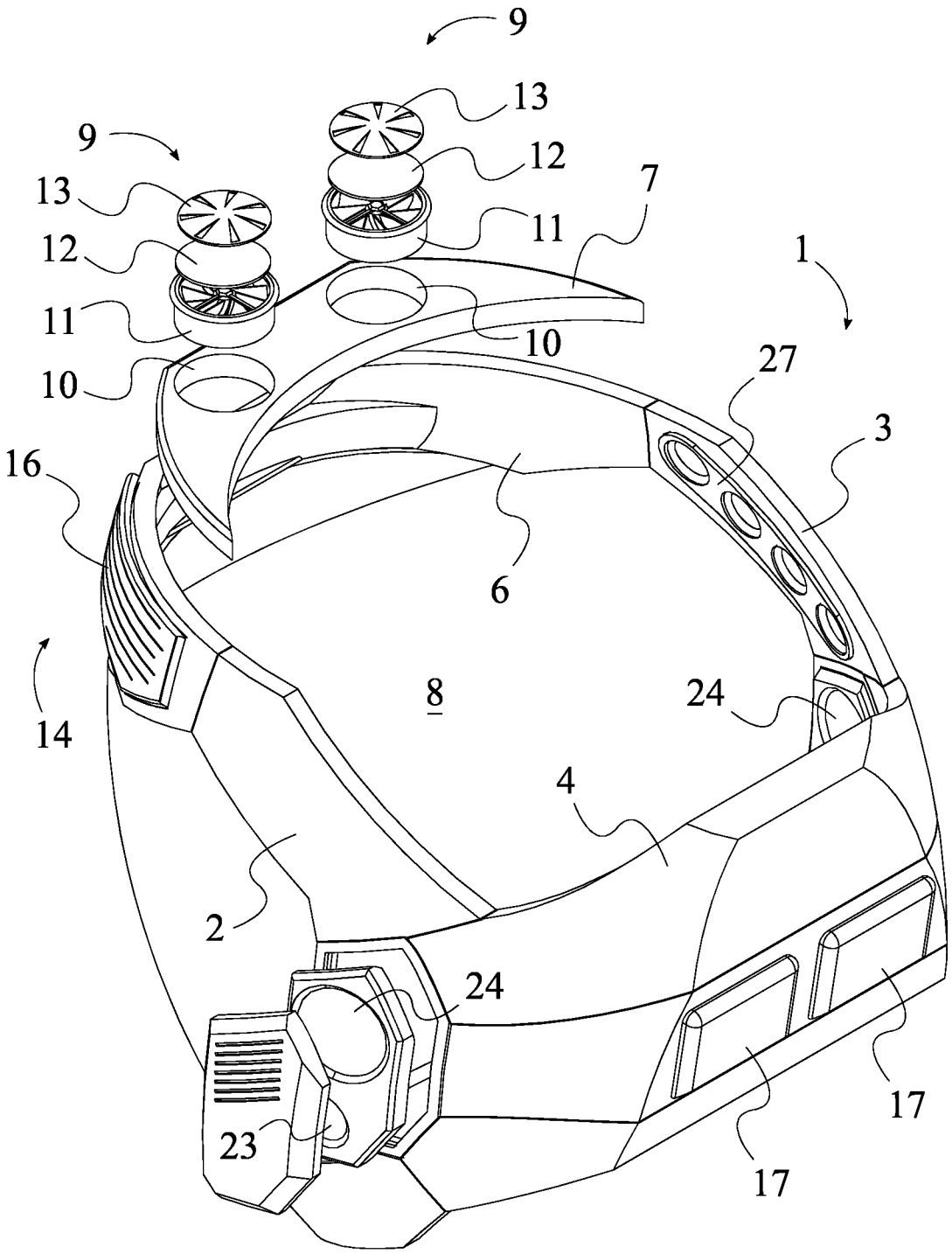
FIG. 5 is a back perspective view of the present invention with the ventilation system exploded.

The at least one ventilation system 9 must be capable of providing a user with air that is safe for inhalation. To this end, the at least one ventilation system 9 may comprise a fan chamber 10, a ventilation fan 11, and a layered air filter 12, as shown in FIG. 5. The fan chamber 10 is the generally hollow structure that defines the space through which air may enter the at least one ventilation system 9. The ventilation fan 11 is any of a variety of fluid-directing fans capable of directing air into the present invention, preferably towards a user's mouth and nose. The layered air filter 12 is a multi-segment purification device that removes impurities and particulate matter from air that flows through the layered air filter 12. The layered air filter 12 may include, but is not limited to, fibrous meshes, woven cotton, carbon and activated carbon meshes, and more. The ventilation fan 11 and the layered air filter 12 may be mounted within the fan chamber 10. This arrangement allows the ventilation fan 11 to direct air through the layered air filter 12. The ventilation fan 11 may be in fluid communication with the layered air filter 12. Thus, air may pass through the fan chamber 10 and be purified by the layered air filter 12 as directed by the ventilation fan 11.

Figure 4:
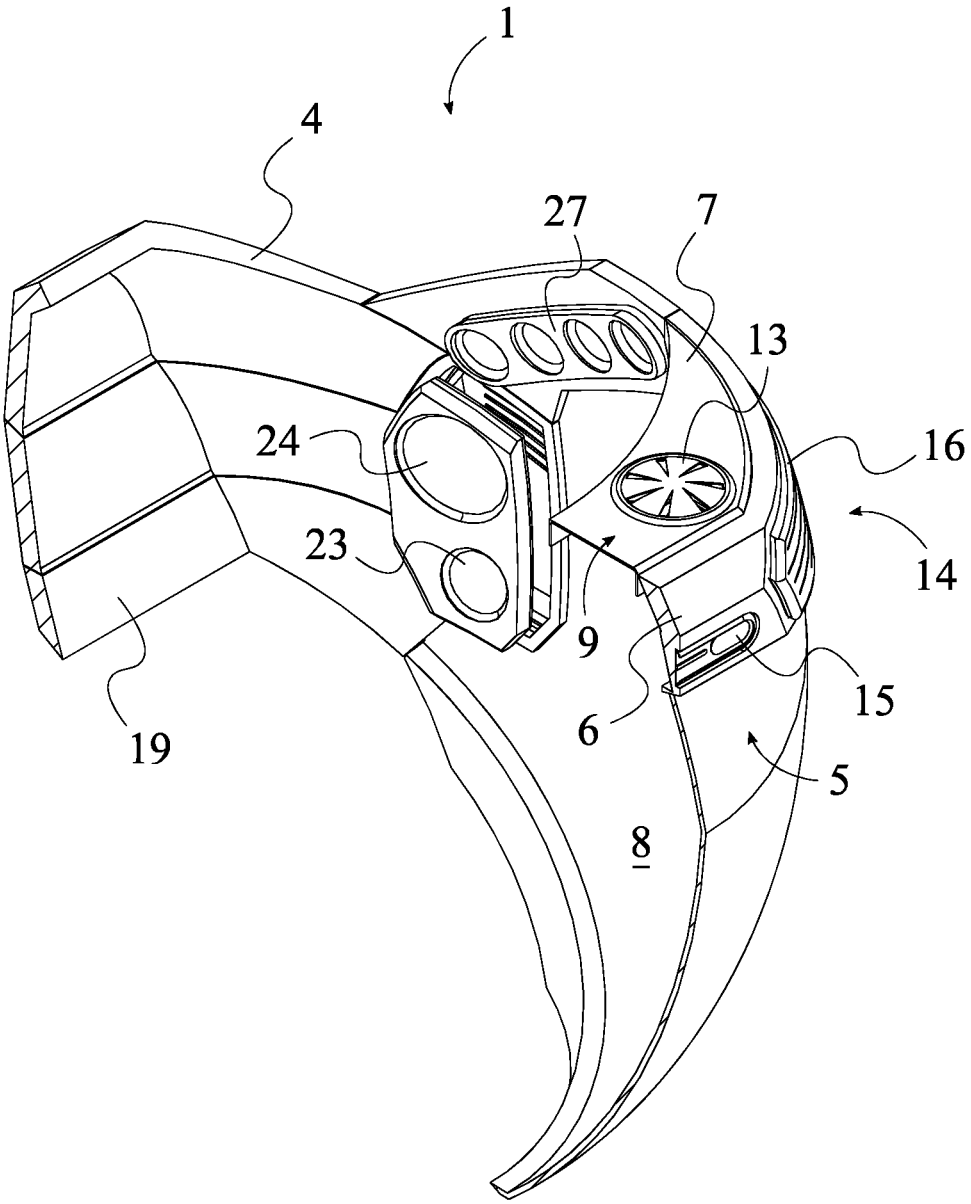
FIG. 4 is a front perspective sectional view about line 4-4 in FIG. 3 of the present invention.

The ventilation fan 11 and the layered air filter 12 may be susceptible to physical damage in hazardous conditions. In order to prevent this, the at least one ventilation system 9 may further comprise a ventilated filter guard 13, as shown in FIG. 4. The ventilated filter guard 13 is a protective rigid unit that limits physical access to the ventilation fan 11 and the layered air filter 12 without restricting air from passing through the ventilation fan 11 and the layered air filter 12. The ventilated filter guard 13 may be mounted within the fan chamber 10. In this way, the ventilated filter guard 13 may be oriented optimally to protect the ventilation fan 11 and the layered air filter 12. The layered air filter 12 may be positioned in between the ventilation fan 11 and the ventilated filter guard 13. This arrangement ensures that air passing through the ventilated filter guard 13 is filtered before entering into the wearer's breathing space. The layered air filter 12 may be positioned against the ventilated filter guard 13. Thus, the layered air filter 12 may filter all air passing through the ventilated filter guard 13.

It is often preferable to provide the user with different entrances for filtered air. To this end, the at least one ventilation system 9 may be a first ventilation system and a second ventilation system, as shown in FIG. 1. The first ventilation system and the second ventilation system are a pair of filtration systems that allow for air to enter the present invention. The first ventilation system and the second ventilation system may be positioned offset from each other across the proximal portion 6. Thus, the user may receive filtered air from different positions upon the forehead brace 5.

Figure 3:
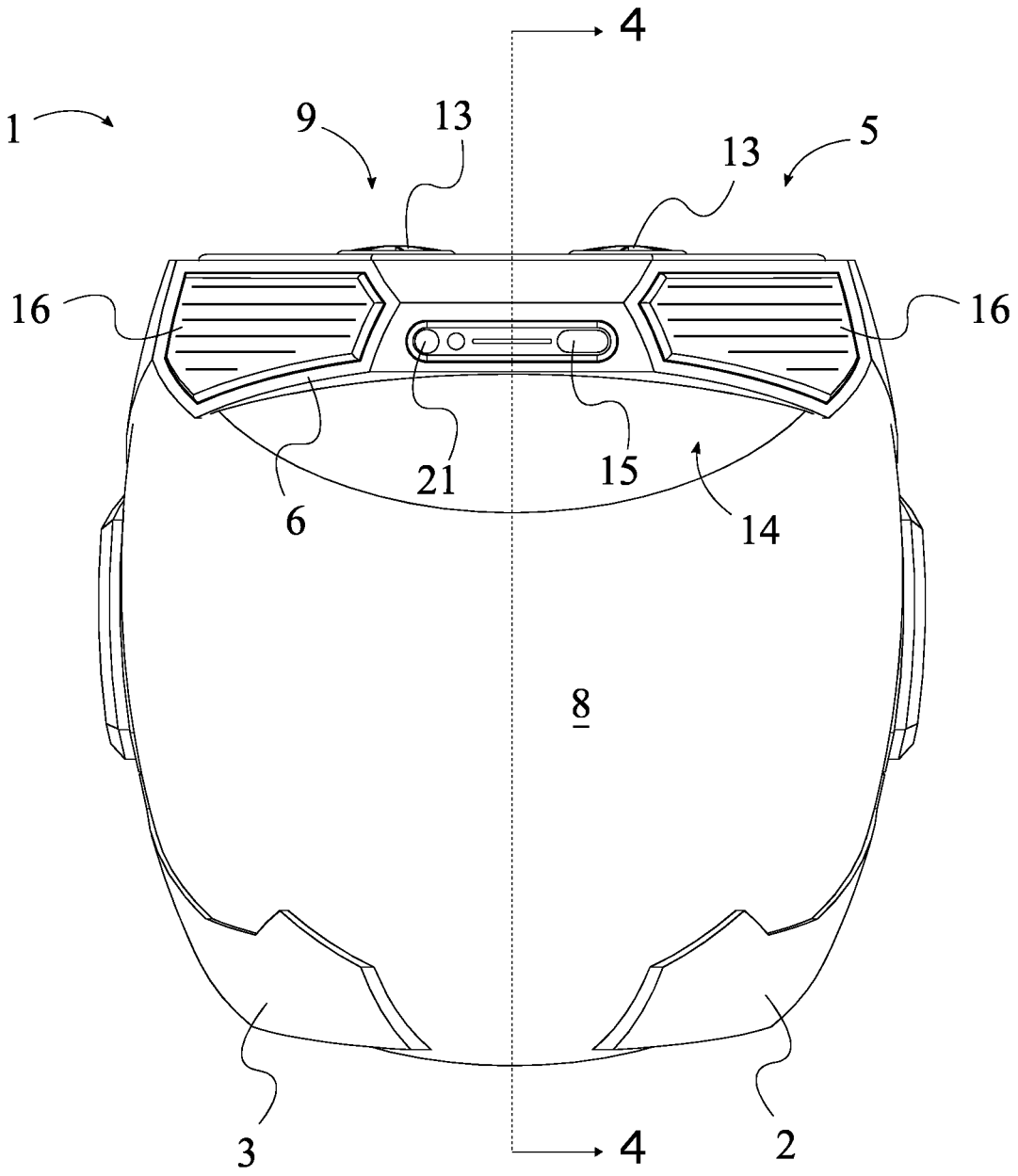
FIG. 3 is a front view of the present invention.

The illumination system 14 must provide the user with different lighting capabilities. To this end, the illumination system 14 may comprise at least one high-luminosity light 15, as shown in FIG. 3. The at least one high-luminosity light 15 is a powerful flash-type light capable of illuminating a targeted area, either for an extended period of time as per a blinding safety light, or briefly as per a photo camera flash. The at least one high-luminosity light 15 may be centrally positioned on the proximal portion 6. This arrangement directs the at least one high-luminosity light 15 towards a target directly in front of the user's face.

A user may also wish for the illumination system 14 to illuminate a wide area for an extended time period. To enable this, the illumination system 14 may further comprise a plurality of area lights 16, as shown in FIG. 3. The plurality of area lights 16 is a set of fluorescent, incandescent, halogen, light-emitting diode (LED), or other such lights capable of dispersing light across a wide area. The plurality of area lights 16 may be distributed across the proximal portion 6. Thus, the user may illuminate a wide area around the present invention, filling a room or other such area with light.

Comfortable usage and safety from physical damage are paramount to the success of any device meant to offer cranial protection. To this end, the present invention may further comprise at least one internal cushion 19, as shown in FIG. 4. The at least one internal cushion 19 relates to any of a variety of pads capable of diffusing physical impacts. The at least one internal cushion 19 may be positioned within the frame 1. This arrangement enables the at least one internal cushion 19 to contact, in the preferred usage of the present invention, the back of a user's head. The at least one internal cushion 19 may be connected onto the rear brace 4. Thus, the at least one internal cushion 19 prevents damage from occurring to the user's head in the event of an impact or physical assault.

The present invention may benefit from additional mechanisms to secure to a user's head. To enable this, the present invention may further comprise at least one length-adjustable band 20, as shown in FIG. 2. The at least one length-adjustable band 20 relates to a strap or other such flexible, generally inelastic member capable of fastening the user's head in position within the present invention. The at least one length-adjustable band 20 may be tethered from the left lateral cowl 2, against the rear brace 4, and to the right lateral cowl 3. This arrangement enables a user to place the at least one length-adjustable band 20 under the user's chin or behind the user's head to secure the present invention in place atop the user's head.

Figure 6:
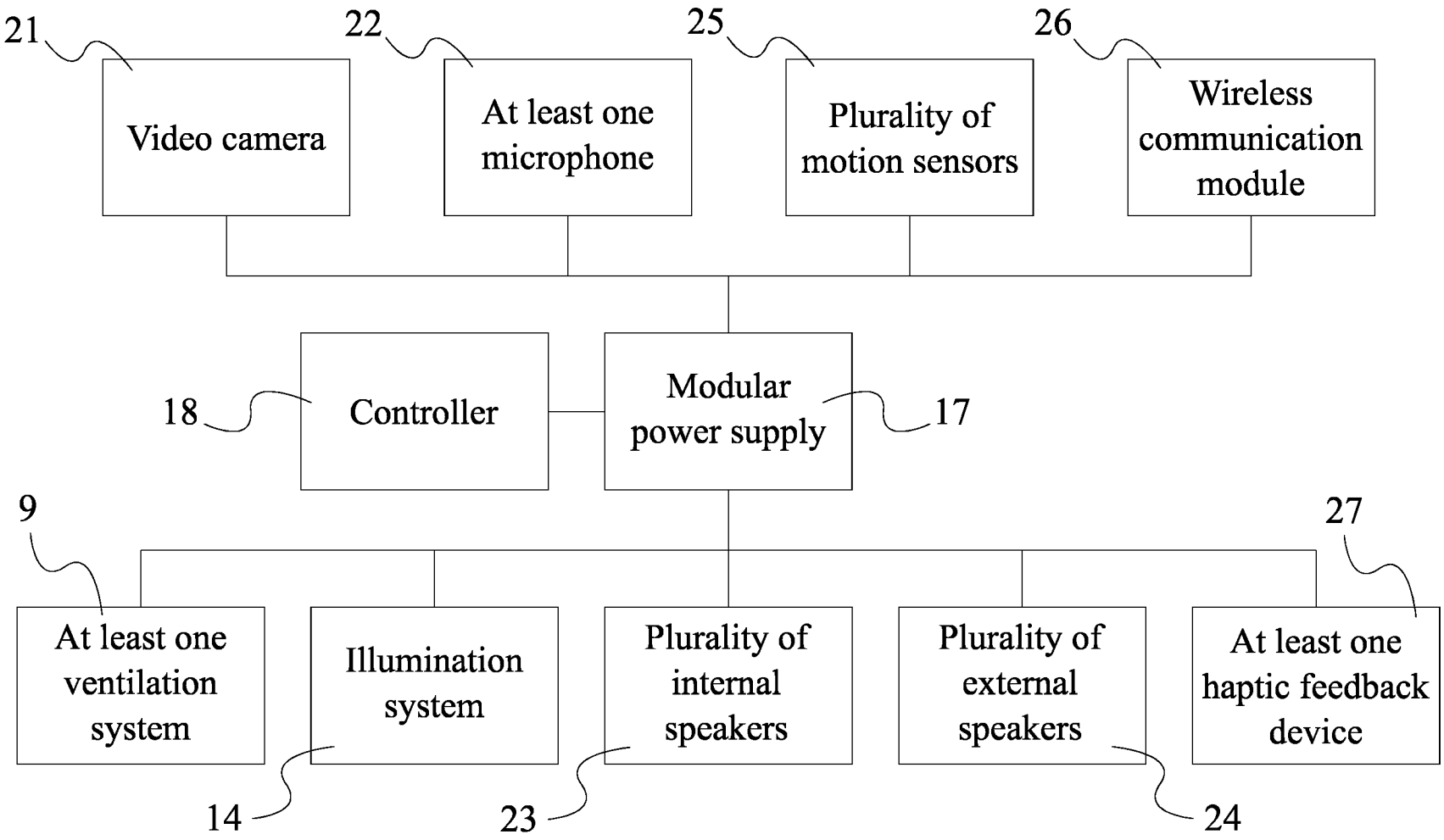
FIG. 6 is a schematic diagram representing the electrical connections of the present invention.
Figure 7:
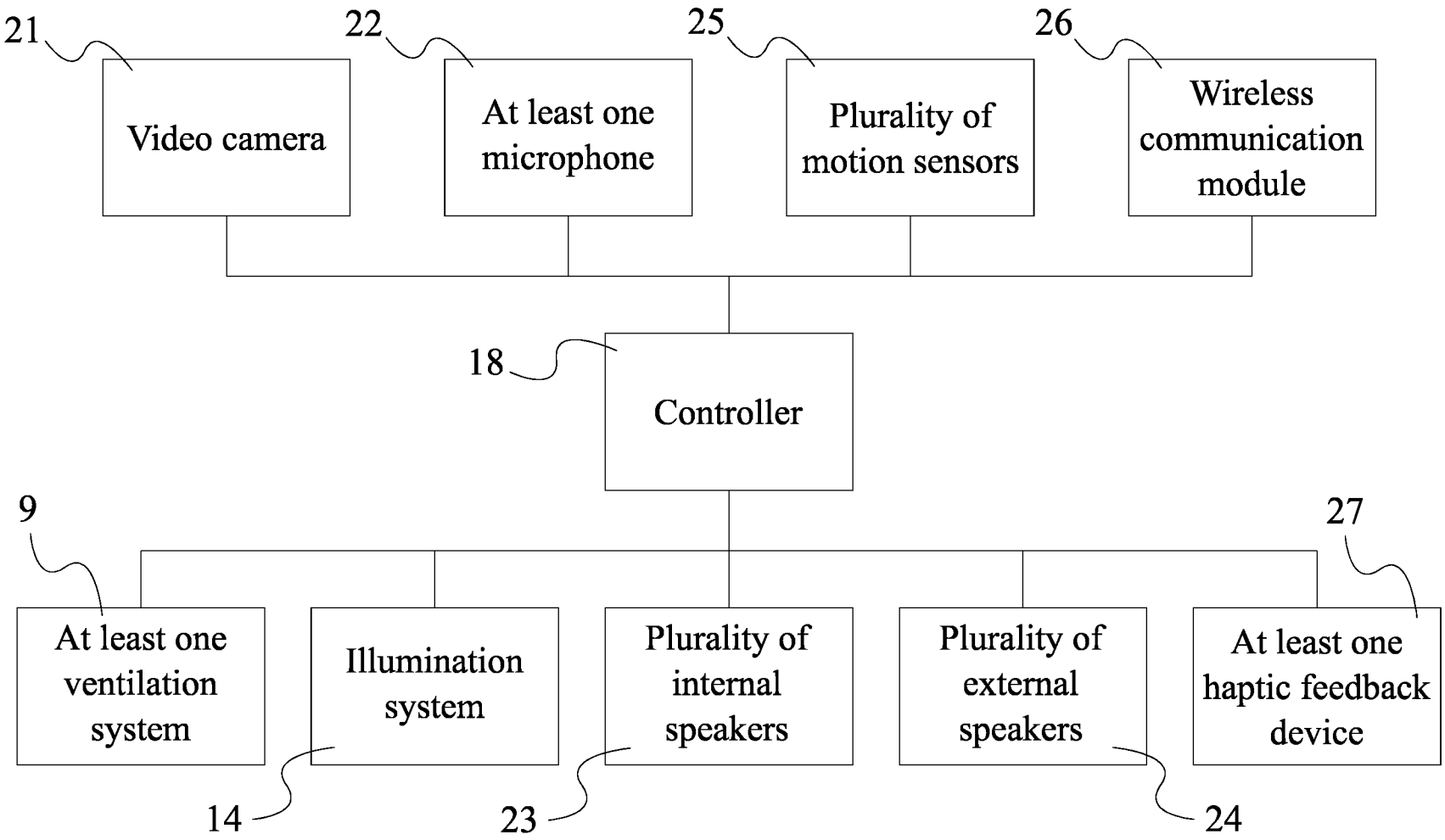
FIG. 7 is a schematic diagram representing the electronic connections of the present invention.

The user may wish to visually record information and events as they occur. To allow for this, the present invention may further comprise a video camera 21, as represented in FIGS. 6 and 7. The video camera 21 is a lens-based optical device that captures and joins consecutive images within the view of the video camera 21. The video camera 21 may include any type or combination of lenses, including a fish-eye lens, a magnifying lens, or other such optical tools. The video camera 21 may be integrated into the proximal portion 6. This arrangement allows the video camera 21 to capture images and scenes occurring in front of the user. The controller 18 may be electronically connected to the video camera 21. This arrangement allows the controller 18 to send signal commands to and collect data from the video camera 21. The modular power supply 17 may be electrically connected to the video camera 21. In this way, the video camera 21 may always have adequate power necessary to capture visuals in front of the user.

The present invention may benefit from the ability to register and collect sounds and audio data from the environment. To this end, the present invention may further comprise at least one microphone 22, as represented in FIGS. 6 and 7. The at least one microphone 22 relates to an audio sensor capable of collecting audio data, converting that data into electronic signals, and relaying that data to the controller 18. The at least one microphone 22 may be integrated into the frame 1. This arrangement allows the at least one microphone 22 to collect ambient sounds proximal to the user. The controller 18 may be electronically connected to the at least one microphone 22. Thus, the controller 18 may send signal commands to and collect data from the at least one microphone 22. The modular power supply 17 may be electrically connected to the at least one microphone 22. In this way, the at least one microphone 22 may always have adequate power necessary to capture ambient audio from around the present invention.

In some uses of the present invention, a user may wish to gather information from an external party, play music, or otherwise receive audio input. To enable this, the present invention may further comprise a plurality of internal speakers 23, as represented in FIGS. 6 and 7. The plurality of internal speakers 23 is a set of audio tools used to convert and subsequently amplify electronic wave signals into sounds within the present invention. The plurality of internal speakers 23 may be integrated into the left lateral cowl 2 and the right lateral cowl 3. This arrangement ensures that the plurality of internal speakers 23 may be positioned, in a preferred usage of the present invention, appropriately adjacent to a user's ears. The controller 18 may be electronically connected to the plurality of internal speakers 23. This arrangement allows the controller 18 to send signal commands to the plurality of internal speakers 23. The modular power supply 17 may be electrically connected to the plurality of internal speakers 23. Thus, the plurality of internal speakers 23 may always have adequate power necessary to distribute audio to the user's ears during use.

It may be further desirable to send audio out to a large area or crowd of people in order to communicate information. To enable this, the present invention may further include a plurality of external speakers 24, as represented in FIGS. 6 and 7. The plurality of external speakers 24 relates to a set of audio tools used to convert and subsequently amplify electronic wave signals into sounds outside of the present invention. The plurality of external speakers 24 may be externally connected onto the frame 1. This arrangement enables broad distribution of sound waves in multiple directions. The controller 18 may be electronically connected to the plurality of external speakers 24. Thus, the controller 18 may send signal commands to the plurality of external speakers 24. The modular power supply 17 may be electrically connected to the plurality of external speakers 24. Thus, the plurality of external speakers 24 may always have adequate power necessary to distribute audio around the present invention.

It may be advantageous for the user to be aware of movement occurring around the present invention. To this end, the present invention may further comprise a plurality of motion sensors 25, as represented in FIGS. 6 and 7. The plurality of motion sensors 25 is a set of electronic sensors that are capable of detecting changes in position of nearby objects. The plurality of motion sensors 25 may be externally connected onto the frame 1. Thus, the plurality of motion sensors 25 may register motion in the area surrounding the user of the present invention. The controller 18 may be electronically connected to the plurality of motion sensors 25. This arrangement allows the controller 18 to receive signals from the plurality of motion sensors 25. The modular power supply 17 may be electrically connected to the plurality of motion sensors 25. In this way, the plurality of motion sensors 25 may always have adequate power necessary to detect external movement around the frame 1.

A user may wish to communicate over distances with different devices, people, or software systems. To allow this, the present invention may further comprise a wireless communication module 26, as represented in FIGS. 6 and 7. The wireless communication module 26 is a device capable of generating and sending short-range or long-range signals over distances. The wireless communication module 26 may be integrated into the frame 1. This arrangement prevents the wireless communication module 26 from potentially receiving physical damage while simultaneously positioning the wireless communication module 26 adjacent to the modular power supply 17 and the controller 18 for necessary electronic connection. The controller 18 may be electronically connected to the wireless communication module 26. This arrangement allows the controller 18 to send signal commands to the wireless communication module 26. The modular power supply 17 may be electrically connected to the wireless communication module 26. In this way, the wireless communication module 26 may always have adequate power necessary to connect the present invention to external devices.

Many users may wish to connect this device to a video game or virtual reality system to improve immersion or may wish to better sense their environments while wearing the present invention. To this end, the present invention may further comprise at least one haptic feedback device 27, as represented in FIGS. 6 and 7. The at least one haptic feedback device 27 relates to a system of devices capable of simulating contact and other physical stimuli. The at least one haptic feedback device 27 may be integrated into the left lateral cowl 2 and the right lateral cowl 3. This arrangement enables the user to obtain a sense of direction from the coordinated outputs of the at least one haptic feedback device 27. The controller 18 may be electronically connected to the at least one haptic feedback device 27. This arrangement allows the controller 18 to send signal commands to the at least one haptic feedback device 27. The modular power supply 17 may be electrically connected to the at least one haptic feedback device 27. Thus, the at least one haptic feedback device 27 may always have adequate power necessary to simulate physical environmental stimuli for a user.

Although the invention has been explained in relation to its preferred embodiment, it is to be understood that many other possible modifications and variations can be made without departing from the spirit and scope of the invention as hereinafter claimed.

What is claimed is:

1. A personal protective headgear comprising:
a frame;
a transparent shield visor;
at least one ventilation system;
an illumination system;
a modular power supply;
a controller;
the frame comprising a left lateral cowl, a right lateral cowl, a rear brace, and a forehead brace;
the forehead brace comprising a proximal portion and a distal portion;
the left lateral cowl and the right lateral cowl being bisymmetrically positioned offset from each other;
the forehead brace and the rear brace being mounted in between the left lateral cowl and the right lateral cowl;
the forehead brace and the rear brace being positioned opposite to each other about the frame;
the transparent shield visor being hermetically connected in between the left lateral cowl, the right lateral cowl, and the proximal portion;
the illumination system being integrated into the proximal portion;
the at least one ventilation system being integrated into the distal portion;
the modular power supply and the controller being mounted into the frame;
the controller being electronically connected to the at least one ventilation system and the illumination system; and
the modular power supply being electrically connected to the at least one ventilation system, the illumination system, and the controller.

2. The personal protective headgear as claimed in claim 1 comprising:
the at least one ventilation system comprising a fan chamber, a ventilation fan, and a layered air filter;
the ventilation fan and the layered air filter being mounted within the fan chamber; and
the ventilation fan being in fluid communication with the layered air filter.

3. The personal protective headgear as claimed in claim 2 comprising:
the at least one ventilation system further comprising a ventilated filter guard;
the ventilated filter guard being mounted within the fan chamber;
the layered air filter being positioned in between the ventilation fan and the ventilated filter guard; and
the layered air filter being positioned against the ventilated filter guard.

4. The personal protective headgear as claimed in claim 1 comprising:
the at least one ventilation system being a first ventilation system and a second ventilation system; and
the first ventilation system and the second ventilation system being positioned offset from each other across the proximal portion.

5. The personal protective headgear as claimed in claim 1 comprising:
the illumination system comprising at least one high-luminosity light; and
the at least one high-luminosity light being centrally positioned on the proximal portion.

6. The personal protective headgear as claimed in claim 1 comprising:
the illumination system comprising a plurality of area lights; and
the plurality of area lights being distributed across the proximal portion.

7. The personal protective headgear as claimed in claim 1 comprising:
at least one internal cushion;
the at least one internal cushion being positioned within the frame; and
the at least one internal cushion being connected onto the rear brace.

8. The personal protective headgear as claimed in claim 1 comprising:
at least one length-adjustable band; and
the at least one length-adjustable band being tethered from the left lateral cowl, against the rear brace, and to the right lateral cowl.

9. The personal protective headgear as claimed in claim 1 comprising:
a video camera;
the video camera being integrated into the proximal portion;
the controller being electronically connected to the video camera; and
the modular power supply being electrically connected to the video camera.

10. The personal protective headgear as claimed in claim 1 comprising:
at least one microphone;
the at least one microphone being integrated into the frame;
the controller being electronically connected to the at least one microphone; and
the modular power supply being electrically connected to the at least one microphone.

11. The personal protective headgear as claimed in claim 1 comprising:
a plurality of internal speakers;
the plurality of internal speakers being integrated into the left lateral cowl and the right lateral cowl;
the controller being electronically connected to the plurality of internal speakers; and
the modular power supply being electrically connected to the plurality of internal speakers.

12. The personal protective headgear as claimed in claim 1 comprising:
a plurality of external speakers;
the plurality of external speakers being externally connected onto the frame;
the controller being electronically connected to the plurality of external speakers; and
the modular power supply being electrically connected to the plurality of external speakers.

13. The personal protective headgear as claimed in claim 1 comprising:
a plurality of motion sensors;
the plurality of motion sensors being externally connected onto the frame;
the controller being electronically connected to the plurality of motion sensors; and the modular power supply being electrically connected to the plurality of motion sensors.

14. The personal protective headgear as claimed in claim 1 comprising:

a wireless communication module;

the wireless communication module being integrated into the frame;

the controller being electronically connected to the wireless communication module; and the modular power supply being electrically connected to the wireless communication module.

15. The personal protective headgear as claimed in claim 1 comprising:

at least one haptic feedback device;

the at least one haptic feedback device being integrated into the left lateral cowl and the right lateral cowl;

the controller being electronically connected to the at least one haptic feedback device; and the modular power supply being electrically connected to the at least one haptic feedback device.

* * * * *